US007403199B2

(12) United States Patent
Kwak et al.

(10) Patent No.: US 7,403,199 B2
(45) Date of Patent: Jul. 22, 2008

(54) ENERGY RECOVERY CIRCUIT AND DRIVING METHOD THEREOF

(75) Inventors: Jong Woon Kwak, Seoul (KR); Jeong Pil Choi, Suwon (KR)

(73) Assignee: LG Electronics Inc., Seoul (KR)

( * ) Notice: Subject to any disclaimer, the term of this patent is extended or adjusted under 35 U.S.C. 154(b) by 638 days.

(21) Appl. No.: 10/850,944

(22) Filed: May 21, 2004

(65) Prior Publication Data

US 2005/0029953 A1 Feb. 10, 2005

(30) Foreign Application Priority Data

May 22, 2003 (KR) ..... 10-2003-0032474

(51) Int. Cl.
*G09G 5/00* (2006.01)

(52) U.S. Cl. ..... 345/211; 345/60; 345/63; 345/212; 345/213; 345/691

(58) Field of Classification Search ..... 345/211–213, 345/691, 60, 63
See application file for complete search history.

(56) References Cited

U.S. PATENT DOCUMENTS 5,861,737 A 1/1999 Goerke
6,989,828 B2 * 1/2006 Correa et al. ..... 345/211
7,102,598 B2 * 9/2006 Onozawa et al. ..... 345/61
2003/0057854 A1 * 3/2003 Roh ..... 315/169.3

FOREIGN PATENT DOCUMENTS

EP 0 261 584 A2 9/1987
EP 1 160 756 A1 11/2000
EP 1 267 320 A2 5/2002

* cited by examiner

*Primary Examiner*—Richard Hjerpe
*Assistant Examiner*—Leonid Shapiro
(74) *Attorney, Agent, or Firm*—Lee, Hong, Degerman, Kang & Schmadeka

(57) ABSTRACT

An energy recovery circuit of the present invention includes a panel capacitor, a source capacitor for recovering and charging the voltage of the panel capacitor and re-providing the charged voltage to the panel capacitor, a reference voltage supply unit for supplying a discharge sustain voltage to the panel capacitor, an inductor disposed between the source capacitor and the panel capacitor, a first switch disposed between the inductor and the source capacitor, a second switch disposed between the inductor and the reference voltage supply unit, a third switch disposed between the inductor and the source capacitor, and a fourth switch connected between the inductor and a base potential, wherein the reference voltage supply unit is disposed so as to be connected with the inductor, for supplying any one of a rising pulse having a predetermined slope and a reference voltage having a predetermined voltage value.

10 Claims, 6 Drawing Sheets

ENERGY RECOVERY CIRCUIT AND DRIVING METHOD THEREOF

CROSS-REFERENCES TO RELATED APPLICATIONS

This Nonprovisional application claims priority under 35 U.S.C. § 119(a) on Patent Application No. 10-2003-032474 filed in Korea on May 22, 2003 the entire contents of which are hereby incorporated by reference.

BACKGROUND OF THE INVENTION

1. Field of the Invention

The present invention relates to a plasma display panel, and more particularly to an energy recovery circuit for use in a driving apparatus of the plasma display panel and a driving method thereof.

2. Background of the Related Art

A plasma display panel (hereinafter, referred to as a 'PDP') is adapted to display an image including characters or graphics by light-emitting phosphors with ultraviolet (147 nm) generated during the discharge of an inert mixed gas such as He+Xe, Ne+Xe or He+Ne+Xe, or the like. This PDP can be easily made thin and large, and it can provide greatly increased image quality with the recent development of the relevant technology. Particularly, a three-electrode AC surface discharge type PDP has advantages of lower driving voltage and longer product lifespan as a wall charge is accumulated on a surface in discharging and electrodes are protected from sputtering caused by discharging.

FIG. 1 is a perspective view showing the configuration of a discharge cell of a conventional plasma display panel. Referring now to FIG. 1, a discharge cell of a three-electrode AC surface discharge type PDP includes a scan electrode Y and a sustain electrode Z which are formed on an upper substrate 10, and an address electrode X formed on a lower substrate 18. Each of the scan electrode Y and the sustain electrode Z include transparent electrodes 12Y and 12Z, and metal bus electrodes 13Y and 13Z which have a line width smaller than that of the transparent electrodes 12Y and 12Z and are respectively disposed at one side edges of the transparent electrodes.

The transparent electrodes 12Y and 12Z, which are generally made of ITO (indium tin oxide), are formed on the upper substrate 10. The metal bus electrodes 13Y and 13Z are generally formed on the transparent electrodes 12Y and 12Z made of metal such as chromium (Cr), and serves to reduce a voltage drop caused by the transparent electrodes 12Y and 12Z having high resistance.

On the upper substrate 10 in which the scan electrode Y and the sustain electrode Z are placed parallel to each other is laminated an upper dielectric layer 14 and a protective layer 16. The upper dielectric layer 14 is accumulated with a wall charge generated during plasma discharging. The protective layer 16 is adapted to prevent damages of the upper dielectric layer 14 due to sputtering caused during plasma discharging, and improve efficiency of secondary electron emission. As the protective layer 16, magnesium oxide (MgO) is generally used.

A lower dielectric layer 22 and a barrier rib 24 are formed on the lower substrate 18 in which the address electrode X is formed. A phosphor layer 26 is applied to the surfaces of both the lower dielectric layer 22 and the barrier rib 24.

The address electrode X is formed on the lower substrate 18 in the direction in which the scan electrode Y and the sustain electrode Z intersect with each other. The barrier rib 24 is in the form of stripe or lattice to prevent leakage of an ultraviolet and a visible light generated by discharging to an adjacent discharge cell. The phosphor layer 26 is excited with an ultraviolet generated during the plasma discharging to generate any one visible light of red, green and blue lights. An inert mixed gas is injected into the discharge spaces defined between the upper substrate 10 and the barrier ribs 24 and between the lower substrate 18 and the barrier ribs 24.

This three-electrode AC surface discharge type PDP is divided into a plurality of sub-fields and is driven. In the period of each of the sub-fields, lights are emitted by the number proportionate to a weighted value of video data, thereby displaying gradations. The plurality of sub-fields are sub-divided into a reset period, an address period, a sustain period and a blanking period, and are driven.

Herein, the reset period is a period for forming an uniform wall charge on the discharge cell, the address period is a period for generating an selective address discharge according to a logical value the video data, and the sustain period is a period for maintaining discharge in the discharge cell from which the address discharge is generated.

As such, an address discharge and a sustain discharge of the AC surface discharge type PDP driven require high voltage of more than several hundreds of volts. Thus, in order to minimize the driving power necessary for the address discharge and the sustain discharge, an energy recovery circuit is used. The energy recovery circuit may recover the voltage between the scan electrode Y and the sustain electrode Z, and may be used as a driving voltage necessary for the subsequent discharge.

FIG. 2 is a circuit diagram showing an energy recovery circuit formed on the scan electrode Y for recovering a voltage of the sustain discharge. Practically, the energy recovery circuit is placed symmetrically to the sustain electrode Z with respect to a central panel capacitor (Cp).

Referring to FIG. 2, a conventional energy recovery circuit includes an inductor L which is connected between a panel capacitor Cp and a source capacitor Cs, a first switch S1 and a third switch S3 which are connected in parallel between the source capacitor Cs and the inductor L, diodes D5 and D6 which are disposed between the first and third switches S1, S3 and the inductor L, and a second switch S2 and the fourth switch S4 which are connected in parallel between the inductor L and the panel capacitor Cp.

The Panel capacitor Cp represents an equivalent circuit of capacitance which is formed between the scan electrode Y and the sustain electrode Z. The second switch S2 is connected to a reference voltage source Vs, and the fourth switch S4 is connected to a base voltage source GND. The source capacitor Cs recovers and charges the voltage which is charged to the panel capacitor Cp during sustain discharging, and provides again the charged voltage to the panel capacitor cp.

To this end, the source capacitor Cs has a capacitance capable of charging the voltage of Vs/2 that corresponds to a half of the reference voltage source Vs. The inductor L forms a resonant circuit together with the panel capacitor Cp. The first to fourth switches S1 to S4 control the flows of current. The fifth diode D5 and the sixth diode D6 both prevent the flow of electric current from reversing. Further, the internal diodes D1 to D4 each disposed within the first to fourth switches S1 to S4 also prevent the flow of electric current from reversing.

FIG. 3 is a timing and waveform diagram showing ON/OFF timings of the switches and output waveforms of the panel capacitors of FIG. 2.

The operation procedure will now be explained on the assumption that the panel capacitor Cp is charged with a voltage of 0 volt and the source capacitor Cs is charged with a voltage of Vs/2 before a period of T1.

In a period of T1, the first switch S1 is turned on, so that an electric current path is formed from the source capacitor Cs to the panel capacitor Cp through the first switch S1 and the inductor L. When the path of electric current is formed, the voltage of Vs/2 charged to the source capacitor Cs is supplied to the panel capacitor Cp. In this time, the inductor L and the panel capacitor Cp form a serial resonant circuit, so that the panel capacitor Cp is charged with the voltage of Vs that is twice the voltage of the source capacitor Cs.

In a period of T2, the second switch S2 is turned on. When the second switch S2 is turned on, the panel capacitor Cp is provided with voltage of the reference voltage source Vs. That is, when the second switch S2 is turned on, the voltage value of the reference voltage source Vs is supplied to the panel capacitor Cp, and hence it is prevented that the voltage value of the panel capacitor Cp become lower than that of the reference voltage source Vs, thereby generating a stable sustain discharge. At this time, because the voltage of the panel capacitor Cp rises up to Vs during a period of T1, the voltage value which is supplied from the outside during a period of T2 may be minimized (that is, it is possible to reduce a power consumption).

In a period of T3, the first switch S1 is turned off. In this time, the panel capacitor Cp maintains the voltage of the reference voltage source Vs. In a period of T4, the second switch S2 is turned off and the third switch S3 is turned on. When the third switch S3 is turned on, an electrical current path is formed from the panel capacitor Cp to the source capacitor Cs through the inductor L and the third switch S3, and the source capacitor Cs recovers the voltage which is charged to the panel capacitor. In this time, the source capacitor Cs is charged with a voltage of Vs/2.

In a period of T5, the third switch S3 is turned off and the fourth switch S4 is turned on. When the fourth switch S4 is turned on, an electric current path is formed between the panel capacitor Cp and the base voltage source GND, and the voltage of the panel capacitor Cp drops to 0 volts. In a period of T6, a state of T5 is remained for a given time period. Practically, an AC driving pulse which is supplied to the scan electrode Y and the sustain electrode Z may be obtained by periodically cycling the periods of T1 to T6.

However, the energy recovery circuit driven according to the aforementioned manner has a problem that the manufacturing cost is increased because the circuit uses the switching elements S1 to S4 having a high internal voltage. More specifically, a first node n1 is supplied with a voltage from the reference voltage source Vs, so that the second switch S2 and the fourth switch S4 must have a higher internal voltage than Vs.

On the other hand, in a normal operation of the energy recovery circuit, a second node n2 is supplied with a voltage of Vs. The source capacitor Cs is charged with a voltage of Vs/2. Therefore, in a normal operation of the energy recovery circuit, the third switch S3 requires only an internal voltage corresponding to a voltage of Vs/2 which is obtained by subtracting a voltage charged to the source capacitor Cs from a voltage applied to the second node n2. However at an initial operation of the energy recovery circuit, since the source capacitor Cs is not charged with voltage, that is, a potential of the source capacitor Cs is set to about 0 volt, an internal voltage of the third switch S3 must be set to a voltage higher than Vs. And the source capacitor Cs is charged with a voltage of Vs/2.

Practically, in order for the source capacitor Cs to be charged with a voltage of Vs/2, the processes of T1 to T6 as shown in FIG. 3 should be repeatedly performed several times. Also, during this processes a value of the voltage applied to across the third switch S3 gradually lowers from Vs to Vs/2, thus an internal voltage of the third switch $S_3$ is set to about Vs.

Furthermore, the first switch S1 is used only when a voltage of the source capacitor Cs is supplied to the inductor L. In this time, a difference in voltage across the first switch S1 is set to a voltage of Vs/2. Therefore, in a normal operation of the energy recovery circuit, the first switch S1 requires only an internal voltage of Vs/2. However, when a base potential is applied to the second node n2, the second node n2 is connected to the base voltage source GND via the inductor L and the fourth switch S4. In this time, a voltage of the second node n2 drops to a potential smaller than that of the base voltage source GND due to peaking phenomenon. Therefore, in the prior art, an internal voltage of the first switch S1 is set to approximately Vs, so that the first switch S1 is prevented from being damaged. That is, all of the first to fourth switches S1 to S4 used in the conventional energy recovery circuit are designed to have a higher internal voltage than Vs, which contributes to an increase in manufacturing cost.

SUMMARY OF THE INVENTION

Therefore, the present invention has been made in view of the above problems, and it is an object of the present invention to provide an energy recovery circuit and driving method thereof which can reduce the manufacturing cost using a switching element having a low internal voltage.

To accomplish the above object, according to the present invention, there is provided an energy recovery circuit including: a panel capacitor formed equivalently on a discharge cell; a source capacitor for recovering and charging the voltage of the panel capacitor, and re-providing the charged voltage to the panel capacitor; a reference voltage supply unit for supplying a discharge sustain voltage to the panel capacitor; an inductor disposed between the source capacitor and the panel capacitor; a first switch disposed between the inductor and the source capacitor, for forming a charge path of the panel capacitor; a second switch disposed between the inductor and the reference voltage supply unit, for forming a discharge sustaining path of the panel capacitor; a third switch disposed between the inductor and the source capacitor, for forming a discharge path of the panel capacitor; and a fourth switch connected between the inductor and a base potential, for forming a path for sustaining the base potential of the panel capacitor, wherein the reference voltage supply unit is disposed is such a manner as to be connected with the inductor, for supplying either a rising pulse having a predetermined slope or a reference voltage having a predetermined voltage value.

BRIEF DESCRIPTION OF THE DRAWINGS

The invention will be described in detail with reference to the following drawing in which like numerals refer to like elements.

DETAILED DESCRIPTION OF THE PREFERRED EMBODIMENT

Figure 1:
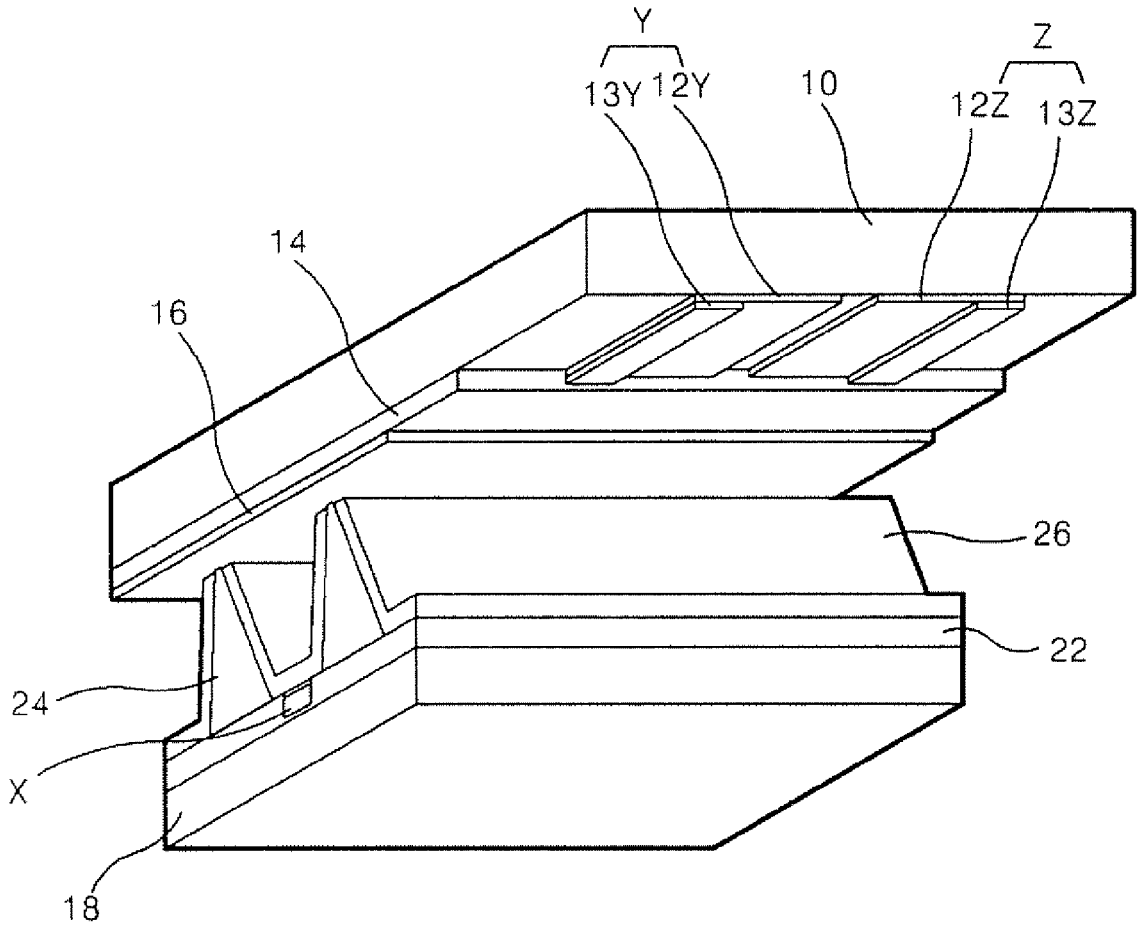
Fig. 1 Prior Art
FIG. 1 is a perspective view showing the configuration of a discharge cell of a conventional three-electrode AC surface discharge type plasma display panel.
Figure 2:
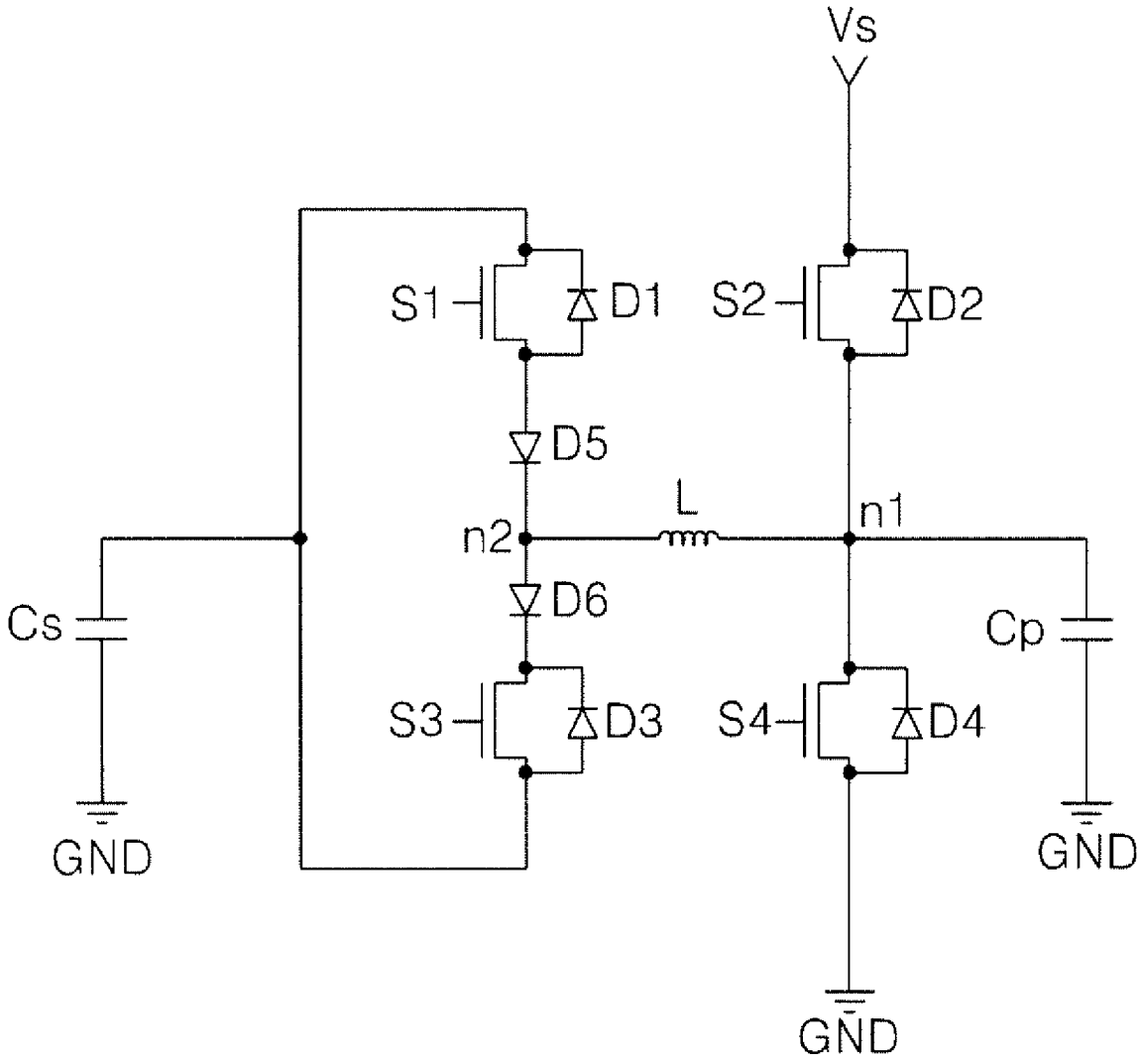
Fig. 2 Prior Art
FIG. 2 is a circuit diagram showing a conventional energy recovery circuit.

Preferred embodiments of the present invention will be described in a more detailed manner with reference to the drawings.

The energy recovery circuit according to the present invention includes a panel capacitor formed equivalently on a discharge cell; a source capacitor for recovering and charging the voltage of the panel capacitor, and re-providing the charged voltage to the panel capacitor; a reference voltage supply unit; an inductor disposed between the source capacitor and the panel capacitor; a first switch disposed between the inductor and the source capacitor, for forming a charge path of the panel capacitor; a second switch disposed between the inductor and the reference voltage supply unit, for forming a discharge sustaining path of the panel capacitor; a third switch disposed between the inductor and the source capacitor, for forming a discharge path of the panel capacitor; and a fourth switch connected between the inductor and a base potential, for forming a path for sustaining the base potential of the panel capacitor, wherein the reference voltage supply unit supplies a rising pulse rising to a predetermined reference voltage to the panel capacitor and the source capacitor respectively at an initial time point in which the panel capacitor and the source capacitor are not charged with a voltage and a reference voltage to the panel capacitor in a normal operation period.

The rising pulse rises up to the reference voltage with a predetermined slope.

The source capacitor is charged with a voltage lower than a voltage which the panel capacitor is charged with by the rising pulse rising to the predetermined reference voltage.

The voltage to be charged to the source capacitor is increased until it reaches a voltage corresponding to approximately half the reference voltage.

The time in which the rising pulse rises to the reference voltage is set in the range from 20 ms to 1 s.

The energy recovery circuit of the present invention further includes a seventh diode disposed between a common terminal of the first switch and inductor and the reference voltage supply unit, for limiting a voltage to be applied to the common terminal to be less than the reference voltage; and an eighth diode disposed between the common terminal and a base voltage source, for limiting the voltage to be applied to the common terminal to be more than the reference voltage.

A method for driving an energy recovery circuit of the present invention includes the steps of: supplying a rising pulse which rises to a predetermined reference voltage with a predetermined slope a panel capacitor and a source capacitor at an initial operation period in which the panel capacitor and the source capacitor are not charged with a voltage; and gradually charging a voltage lower than the predetermined reference voltage a of the rising pulse to the source capacitor by the rising pulse.

When the rising pulse rises up to the predetermined reference voltage, the source capacitor is charged with a voltage corresponding to approximately half the reference voltage.

A slope of the rising pulse is set such that a voltage which is obtained by subtracting a voltage charged to the source capacitor from a voltage value of the rising pulse is maintained to be lower than a voltage corresponding to half the reference voltage.

The time in which the rising pulse rises to the reference voltage is set in the range from 20 ms to 1 s.

Hereinafter, an embodiment of the present invention will be described in further detail with reference to the accompanying drawings, FIG. 4 to FIG. 7.

Figure 4:
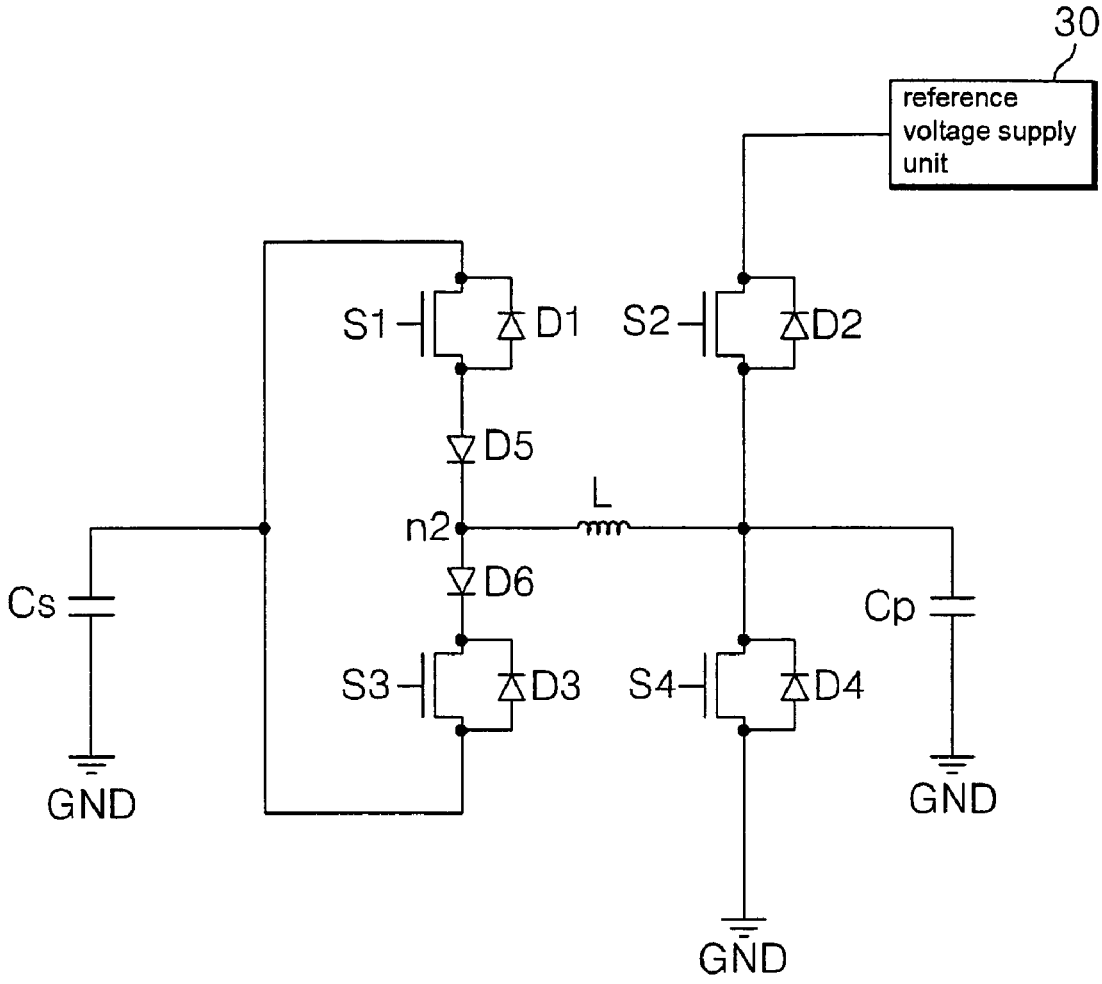
FIG. 4 is a circuit diagram showing an energy recovery circuit according to an embodiment of the present invention.

FIG. 4 is a circuit diagram showing an energy recovery circuit according to an embodiment of the present invention. FIG. 4 shows an energy recovery circuit formed on a scan electrode Y, in which another energy recovery circuit is also formed on a sustain electrode Z to be placed symmetrically with respect to a central panel capacitor (Cp).

Referring to FIG. 4, the energy recovery circuit includes an inductor L which is connected between a panel capacitor Cp and a source capacitor Cs, a first switch S1 and a third switch S3 which are connected in parallel between the source capacitor Cs and the inductor L, diodes D5 and D6 which are disposed between the first and third switches S1, S3 and the inductor L, a second switch S2 and the fourth switch S4 which are connected in parallel between the inductor L and the panel capacitor Cp, and a reference voltage supply unit 30 which is connected to the second switch S2.

The Panel capacitor Cp represents an equivalent circuit of capacitance which is formed between the scan electrode Y and the sustain electrode Z. The second switch S2 is connected to the reference voltage supply unit 30 and the fourth switch S4 is connected to a base voltage source GND. The source capacitor Cs recovers and charges the voltage which is charged to the panel capacitor Cp during sustain discharging to provide the charged voltage to the panel capacitor cp again.

To this end, the source capacitor Cs has a capacitance capable of charging the voltage of Vs/2 that corresponding to half the reference voltage. The inductor L forms a resonant circuit together with the panel capacitor Cp. The first to fourth switches S1 to S4 control the flows of current. A fifth and sixth diodes D5 and D6 serves prevent the flow of electric current from reversing. Further, the internal diodes D1 to D4 each disposed within the first to fourth switches S1 to S4 also serves prevent the flow of electric current from reversing.

Figure 3:
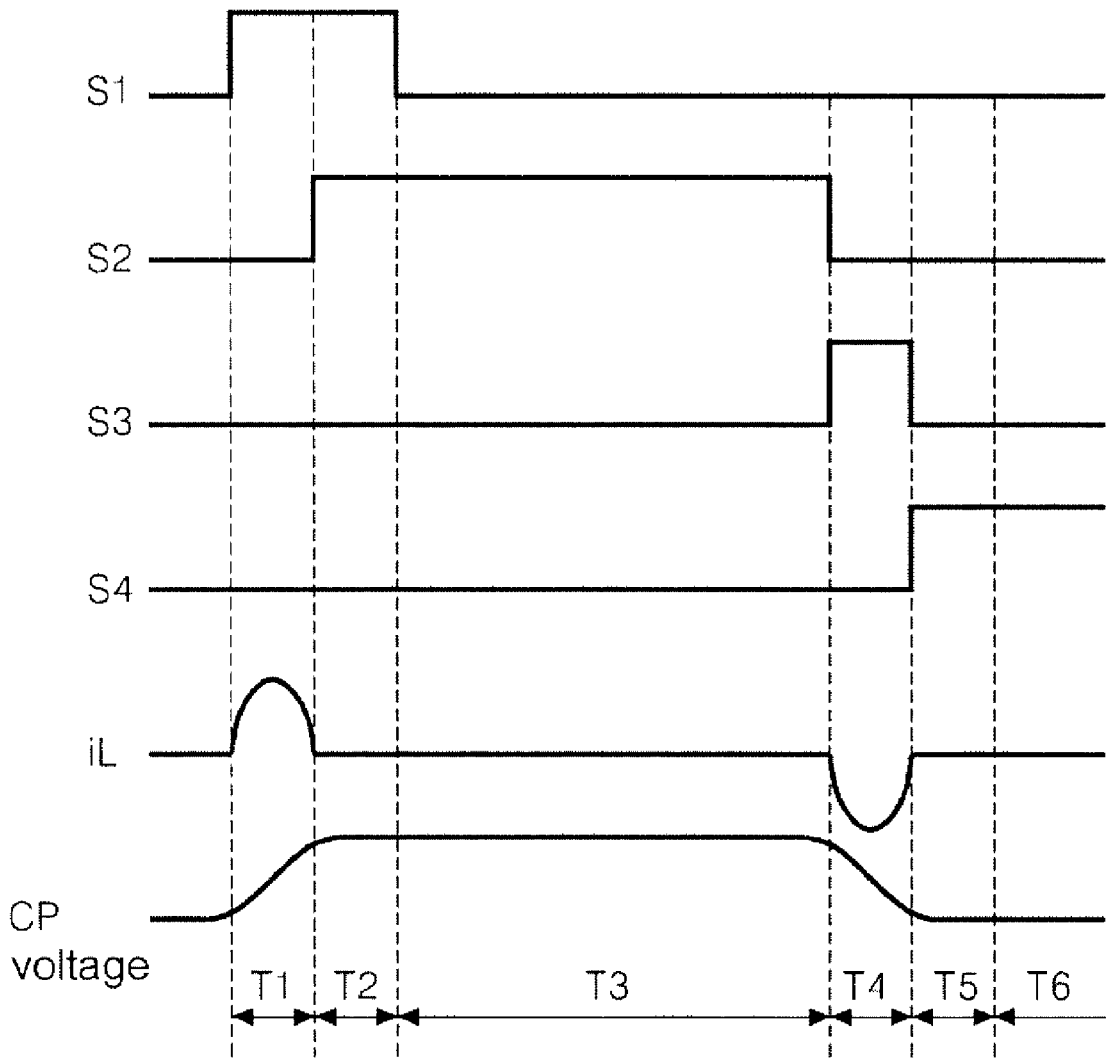
Fig. 3 Prior Art
FIG. 3 is a timing and waveform diagram showing an operation procedure of the energy recovery circuit shown in FIG. 2.

As such, the operation timings of the first switch to fourth switch S1 to S4 according to an embodiment of the present invention are the same as the prior art shown in FIG. 3, thus it will be not explained here in detail.

Figure 5:
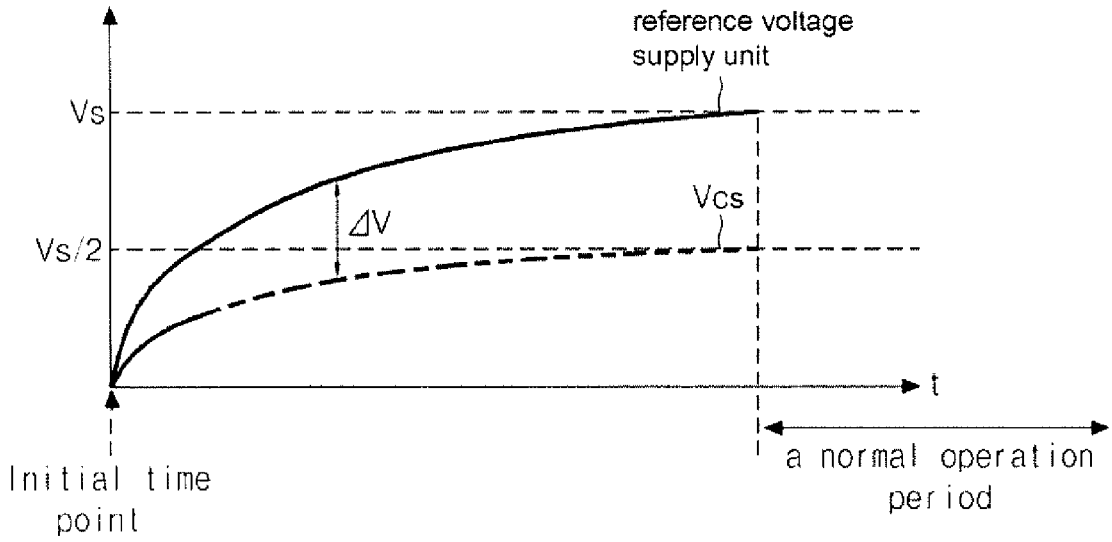
FIG. 5 and FIG. 6 are waveform diagrams showing a voltage applied to across a third switch shown in FIG. 4.

The reference voltage supply unit 30 provides a voltage value of the reference voltage Vs to the second switch S2 when the energy recovery circuit normally operates as shown in FIG. 3. The reference voltage supply unit 30 provides a rising pulse which rises up to a voltage of Vs with a predetermined slope to the second switch S2, as shown in FIG. 5, at an initial time point in which the panel capacitor and the source capacitor are not charged with a voltage. In other word, the reference voltage supply unit 30 provides a rising pulse rising to a predetermined reference voltage to the panel capacitor and the source capacitor respectively at the initial time point in which the panel capacitor and the source capacitor are not charged with a voltage and provides a reference voltage (Vs) to the panel capacitor in normal operation period.

More specifically, the reference voltage supply unit 30 provides a voltage which gradually rises up to the voltage of Vs with a predetermined slope, in an initial operation period of the energy recovery circuit (i.e., the time duration in which the panel capacitor and the source capacitor Cs is charged with a voltage of 0 volt to a voltage of Vs/2 volt). In this time, a voltage provided from the reference voltage supply unit 30 is supplied to the second node n2, accordingly the source capacitor Cs is charged with a voltage which is gradually rising up to the voltage of Vs/2. In the present invention, the slope of the voltage provided from the reference voltage supply unit 30 is set such that the voltage difference (ΔV) between a voltage value which is applied to the second node n2 and a voltage value which is charged to the source capacitor Cs can be set to a voltage less than the voltage of Vs/2. Therefore, according to the embodiment of the present invention, the internal voltage of the third switch SS may be maintained to approximately Vs/2.

Figure 6:
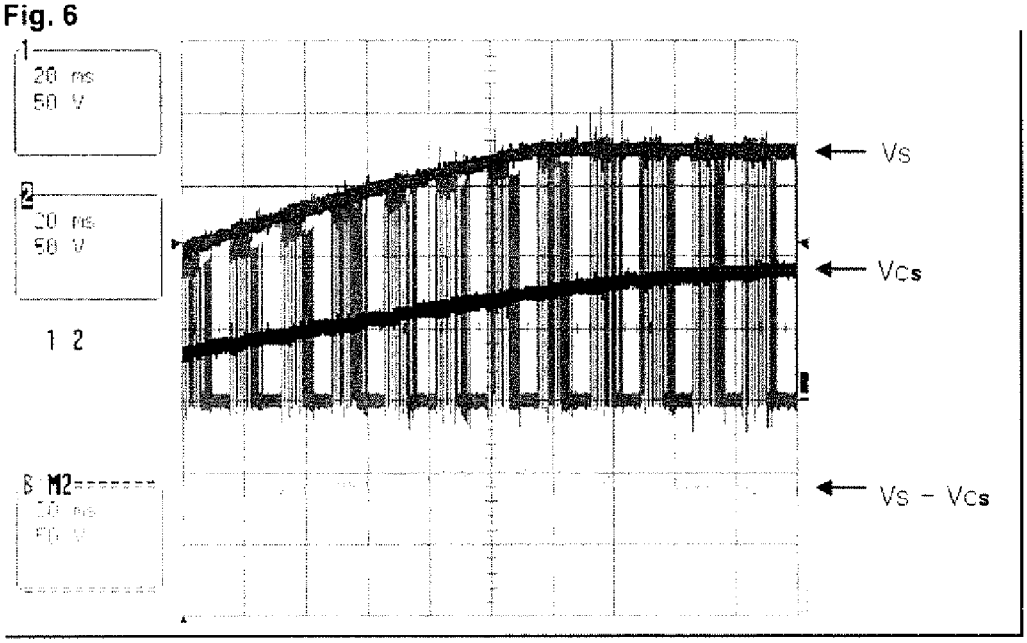
Figure 7:
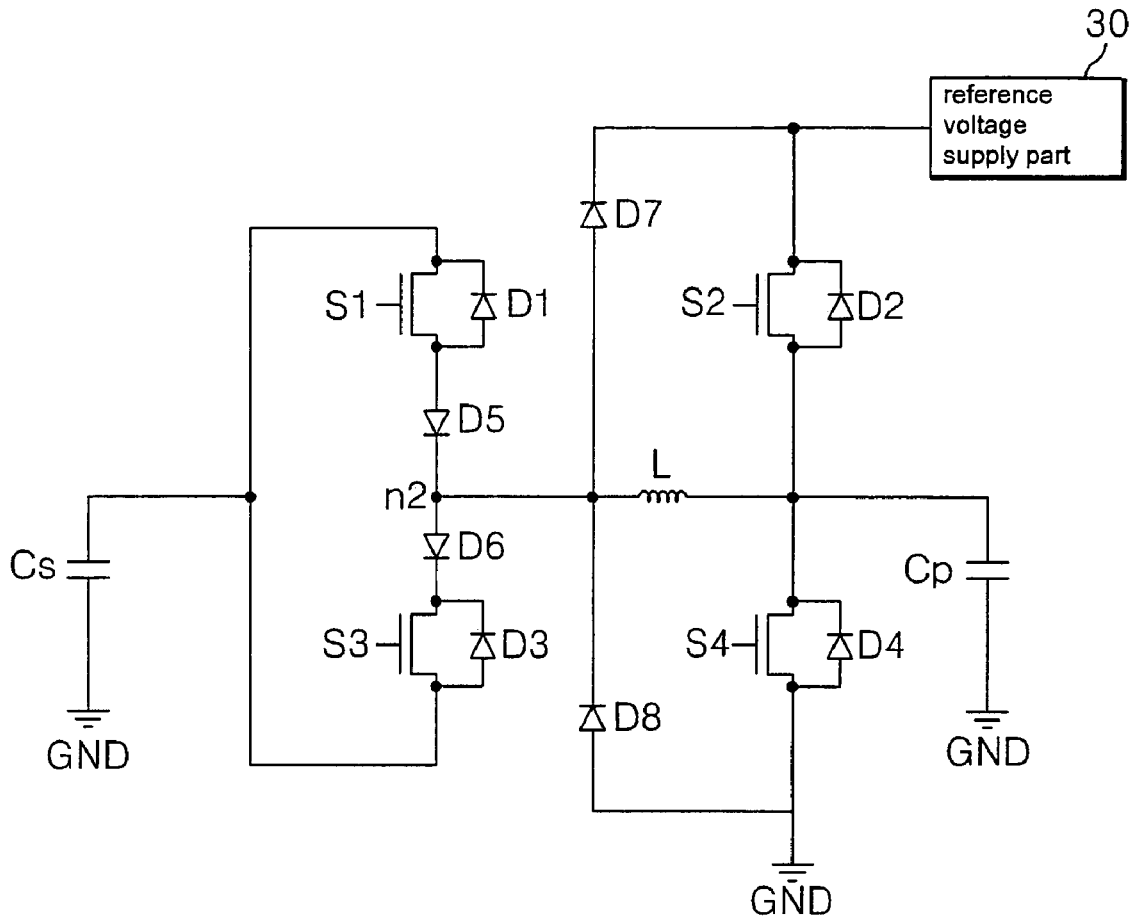
FIG. 7 is a circuit diagram showing an energy recovery circuit according to another embodiment of the present invention.

Practically, as shown in the result of simulation such as a FIG. 6, in case that a voltage value provided from the reference voltage supply unit 30 is gradually rising up to the Vs, the voltage difference across the third switch S3 may be maintained to be less than approximately Vs/2. Therefore, (here, the energy recovery circuit is normally operated) in the present invention, the internal voltage of the third switch S3 can be much lower than the prior art, thereby reducing the manufacturing cost. On the other hand, in the present invention, the time in which the voltage value provided from the reference voltage supply unit 30 rises up to Vs is set to the range from 20 ms (millisecond) to 1 s (second).

Furthermore, the present invention further includes a seventh diode D7 which is connected between the reference voltage supply unit 30 and the second node n2, and a eighth diode D8 which is connected between the base voltage source GND and the second node n2.

The seventh diode D7 is turned on when the voltage of the second node n2 is higher than the reference voltage Vs. That is, the seventh diode D7 is turned on when the second node n2 is supplied with a voltage higher than the reference voltage Vs, and then it prevents the voltage of the second node n2 from rising up to a voltage higher than the reference voltage Vs.

The eighth diode D8 is turned on when the voltage of the second node n2 is lower than the base voltage GND. That is, the eighth diode D8 is turned on when the second node n2 is supplied with a voltage lower than the base voltage GND, and then it prevents the voltage of the second node n2 from dropping to a voltage lower than the base voltage GND. Therefore, the voltage of the second node n2 is always included between the reference voltage Vs and the base voltage GND.

As such, when the voltage of the second node n2 is included between the reference voltage Vs and the base voltage GND, a switch having an internal voltage of approximately Vs/2 is used as the first switch S1. More specifically, a value of voltage applied across the first switch S1 is determined by the source capacitor Cs and the second node n2. Herein, the first switch S1 is used only when a voltage of the source capacitor Cs is supplied to the inductor L, and a voltage difference across the first switch S1 is set to the voltage of Vs/2. However, in the prior art, since the voltage of the second node n2 drops to a voltage less than that of the base potential GND, the first switch S1 had to have a high internal voltage. In contrast with the prior art, according to the present invention, the voltage of the second node n2 does not drop to a voltage of the base potential GND, so that the internal voltage of the first switch S1 may be lowered, thereby reducing the manufacturing cost.

As described above, in the energy recovery circuit and a driving method thereof according to the present invention, the energy recovery circuit is provided with a voltage which is gradually rising up to the reference voltage, so that the internal voltage of the switch may be lowered, thereby reducing the manufacturing cost. Further, the voltage range of one side terminal of the inductor is limited to between the base potential and the reference voltage, so that the internal voltage of the switch may be lowered, thereby also reducing the manufacturing cost.

The invention being thus described, it will be obvious that the same may be varied in many ways. Such variations are not to be regarded as a departure from the sprit and scope of the invention, and all such modifications as would be obvious to one skilled in the art are intended to be included within the scope of the following claims.

What is claimed is:

1. An energy recovery circuit, comprising:

a panel capacitor;

a source capacitor for recovering a voltage from the panel capacitor, and supplying the voltage charged to the source capacitor to the panel capacitor;

a reference voltage supply unit;

an inductor disposed between the source capacitor and the panel capacitor;

a first switch disposed between the inductor and the source capacitor, for forming a charge path of the panel capacitor;

a second switch disposed between the inductor and the reference voltage supply unit, for forming a discharge sustaining path of the panel capacitor;

a third switch disposed between the inductor and the source capacitor, for forming a discharge path of the panel capacitor; and a fourth switch connected between the inductor and a base potential, for forming a path for sustaining the base potential of the panel capacitor, wherein the reference voltage supply unit supplies a rising pulse rising to a predetermined reference voltage to the panel capacitor and the source capacitor respectively at an initial time point in which the panel capacitor and the source capacitor are not charged with a voltage and supplies a reference voltage to the panel capacitor in a normal operation period.

2. The energy recovery circuit of claim 1, wherein the rising pulse rises up to the reference voltage with a predetermined slope.

3. The energy recovery circuit of claim 1, wherein the source capacitor is charged with a voltage lower than a voltage with which the panel capacitor is charged by the rising pulse rising to the predetermined reference voltage.

4. The energy recovery circuit of claim 3, wherein the voltage charged to the source capacitor is increased until it reaches a voltage corresponding to approximately half the reference voltage.

5. The energy recovery circuit of claim 2, wherein the time in which the rising pulse rises to the reference voltage is set in the range from 20 ms to 1 s.

6. The energy recovery circuit of claim 1, further comprising:

a seventh diode disposed between a common terminal of the first switch and inductor and the reference voltage supply unit, for limiting a voltage to be applied to the common terminal to be less than the reference voltage; and an eighth diode disposed between the common terminal and a base voltage source, for limiting the voltage to be applied to the common terminal to be more than the reference voltage.

7. A method for driving an energy recovery circuit, the method comprising:

supplying a rising pulse which rises to a predetermined reference voltage with a predetermined slope to a panel capacitor and a source capacitor at an initial operation period in which the panel capacitor and the source capacitor are not charged with a voltage; and gradually charging a voltage lower than the predetermined reference voltage of the rising pulse to the source capacitor by the rising pulse.

8. The method of claim 7, wherein when the rising pulse rises up to the predetermined reference voltage, the source capacitor is charged with a voltage corresponding to approximately half the reference voltage.

9. The method of claim 7, wherein a slope of the rising pulse is set such that a voltage which is obtained by subtracting a voltage charged to the source capacitor from a voltage value of the rising pulse is maintained to be lower than a voltage corresponding to half the reference voltage.

10. The method of claim 8, wherein the time in which the rising pulse rises to the reference voltage is set in the range from 20 ms to 1 s.

* * * * *